US008931377B2

(12) United States Patent
Wang

(10) Patent No.: US 8,931,377 B2
(45) Date of Patent: Jan. 13, 2015

(54) FITTING STRUCTURE FOR TOOLS

(71) Applicant: Yao-Hung Wang, Taichung (TW)

(72) Inventor: Yao-Hung Wang, Taichung (TW)

( * ) Notice: Subject to any disclaimer, the term of this patent is extended or adjusted under 35 U.S.C. 154(b) by 166 days.

(21) Appl. No.: 13/726,644

(22) Filed: Dec. 26, 2012

(65) Prior Publication Data

US 2014/0174264 A1 Jun. 26, 2014

(51) Int. Cl.
*B25B 23/00* (2006.01)

(52) U.S. Cl.
CPC ..... *B25B 23/0035* (2013.01)
USPC ..... 81/180.1; 891/121.1

(58) Field of Classification Search
CPC B25B 13/06; B25B 23/0007; B25B 23/0035; B25G 1/063
USPC ..... 81/121.1, 124.3, 180.1, 184
See application file for complete search history.

(56) References Cited

U.S. PATENT DOCUMENTS

| | | | | |
|---|---|---|---|---|
| 4,259,883 | A * | 4/1981 | Carlson | 81/62 |
| 4,308,768 | A * | 1/1982 | Wagner | 81/60 |
| 4,328,720 | A * | 5/1982 | Shiel | 81/63 |
| 5,295,422 | A * | 3/1994 | Chow | 81/124.3 |
| 5,448,930 | A * | 9/1995 | Miner et al. | 81/57.39 |
| 5,626,062 | A * | 5/1997 | Colvin | 81/63.2 |
| 5,647,252 | A * | 7/1997 | Miner | 81/62 |
| 5,819,606 | A * | 10/1998 | Arnold | 81/124.3 |
| 5,848,561 | A * | 12/1998 | Hsieh | 81/59.1 |
| 5,857,390 | A * | 1/1999 | Whiteford | 81/62 |
| 5,901,620 | A * | 5/1999 | Arnold | 81/63.2 |
| 6,006,631 | A * | 12/1999 | Miner et al. | 81/177.85 |
| 6,389,931 | B1 * | 5/2002 | Delaney et al. | 81/60 |
| 6,868,759 | B2 * | 3/2005 | Tuan-Mu | 81/63.2 |
| 6,971,286 | B2 * | 12/2005 | Hu | 81/63.2 |
| 7,032,478 | B2 * | 4/2006 | Hu | 81/63.2 |
| 7,055,409 | B2 * | 6/2006 | Hsien | 81/60 |
| 7,059,218 | B1 * | 6/2006 | Lin et al. | 81/60 |
| 7,231,851 | B2 * | 6/2007 | Tuan-Mu | 81/63.2 |
| 8,459,151 | B2 * | 6/2013 | Wang et al. | 81/63.2 |
| 2008/0047402 | A1 * | 2/2008 | Lin | 81/177.85 |
| 2009/0324326 | A1 * | 12/2009 | Lin | 403/322.2 |
| 2010/0096790 | A1 * | 4/2010 | Huang | 269/49 |
| 2012/0060656 | A1 * | 3/2012 | Chang | 81/438 |

* cited by examiner

*Primary Examiner* — David B Thomas

(57) ABSTRACT

A fitting structure for tools contains: a fitting end of a fitting tool and a fitted end of a fitted tool. The fitting end includes a toothed retaining area formed on an inner wall thereof, a concaved portion defined on an upper end thereof, a peripheral groove arranged around the concaved portion, and a ring disposed in the peripheral groove. The fitted tool includes a working portion arranged on a lower end thereof, a polygonal engaging portion defined over the working portion, an annular locking portion formed over the polygonal engaging portion. The annular locking portion has an annular lock trough defined thereon, and the annular lock trough has a color marking element fixed therein for identifying the fitted tool.

4 Claims, 9 Drawing Sheets

FITTING STRUCTURE FOR TOOLS

FIELD OF THE INVENTION

The present invention relates to a fitting structure which has a fitting tool and a fitted tool, both of which are connected together or removed quickly and easily.

BACKGROUND OF THE INVENTION

As shown in FIGS. 1-3, a conventional fitting tool 10 is a ratchet wrench and includes a fitting end 11 mounted on a front end thereof, a toothed retaining area 12 defined therein, a peripheral grove 13 formed on the toothed retaining area 12, and a C-type retainer 14 retained in the peripheral grove 13. A fitted tool 20 is a socket for matching with the fitting tool 10 and includes a working portion 21, a fitted end 22 over the working portion 21, a polygonal engaging portion 23 formed on the fitted end 22, and a cutout 24 defined on a respective one of the at least one side of the polygonal engaging portion 23. Thereby, when the fitting tool 10 is coupled with the fitted tool 20, the polygonal engaging portion 23 of the fitted end 22 is inserted into the toothed retaining area 12 of the fitting end 11, and the C-type retainer 14 in the peripheral grove 13 engages with the at least one cutout 24.

However, the C-type retainer 14 is made of metal material, so when the fitting tool 10 is removed from the fitted tool 20, the user has to remove the fitting tool 10 from the fitted tool 20 forcefully, thus operating the fitting tool laboriously. In addition, the C-type 14 is connected with the fitting end 11 difficultly.

The present invention has arisen to mitigate and/or obviate the afore-described disadvantages.

SUMMARY OF THE INVENTION

The primary object of the present invention is to provide a fitting structure which has a fitting tool and a fitted tool, both of which are connected together or removed quickly and easily.

Another object of the present invention is to provide a fitting structure which has a color marking element fixed therein for identifying the fitted tool clearly and easily.

To obtain the above objectives, a fitting structure provided by the present invention contains:

a fitting end of a fitting tool and a fitted end of a fitted tool;

the fitting end including a toothed retaining area formed on an inner wall thereof, a concaved portion defined on an upper end thereof, a peripheral groove arranged around the concaved portion, and a ring disposed in the peripheral groove;

the fitted tool including a working portion arranged on a lower end thereof, a polygonal engaging portion defined over the working portion, an annular locking portion formed over the polygonal engaging portion, wherein the annular locking portion has an annular lock trough defined thereon, and the annular lock trough has a color marking element fixed therein for identifying the fitted tool;

wherein when the fitting end of the fitting tool is connected with the fitted end of the fitted tool, the polygonal engaging portion of the fitted end retains in the toothed retaining area of the fitting end, and the annular locking portion of the fitted end is engaged in the concaved portion of the fitting end, the fitting tool is retained in the annular lock trough of the annular locking portion of the fitted tool by ways of the ring, such that the fitting end of the fitting tool is connected with the fitted end of the fitted tool securely.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
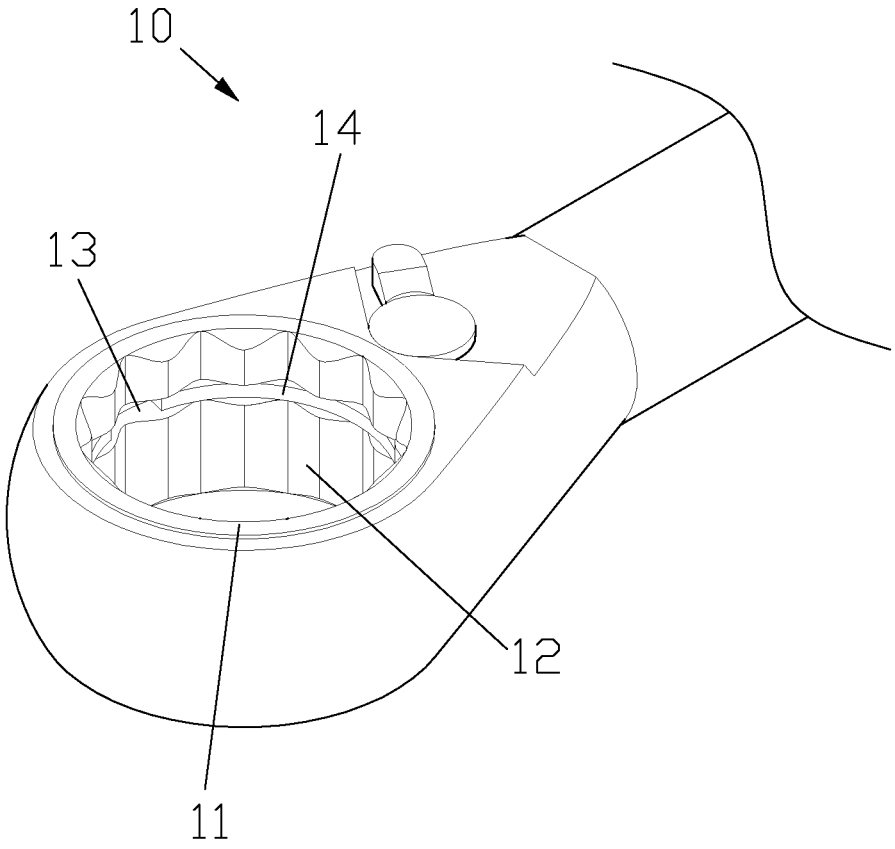
FIG. 1 shows a conventional fitting tool.
Figure 2:
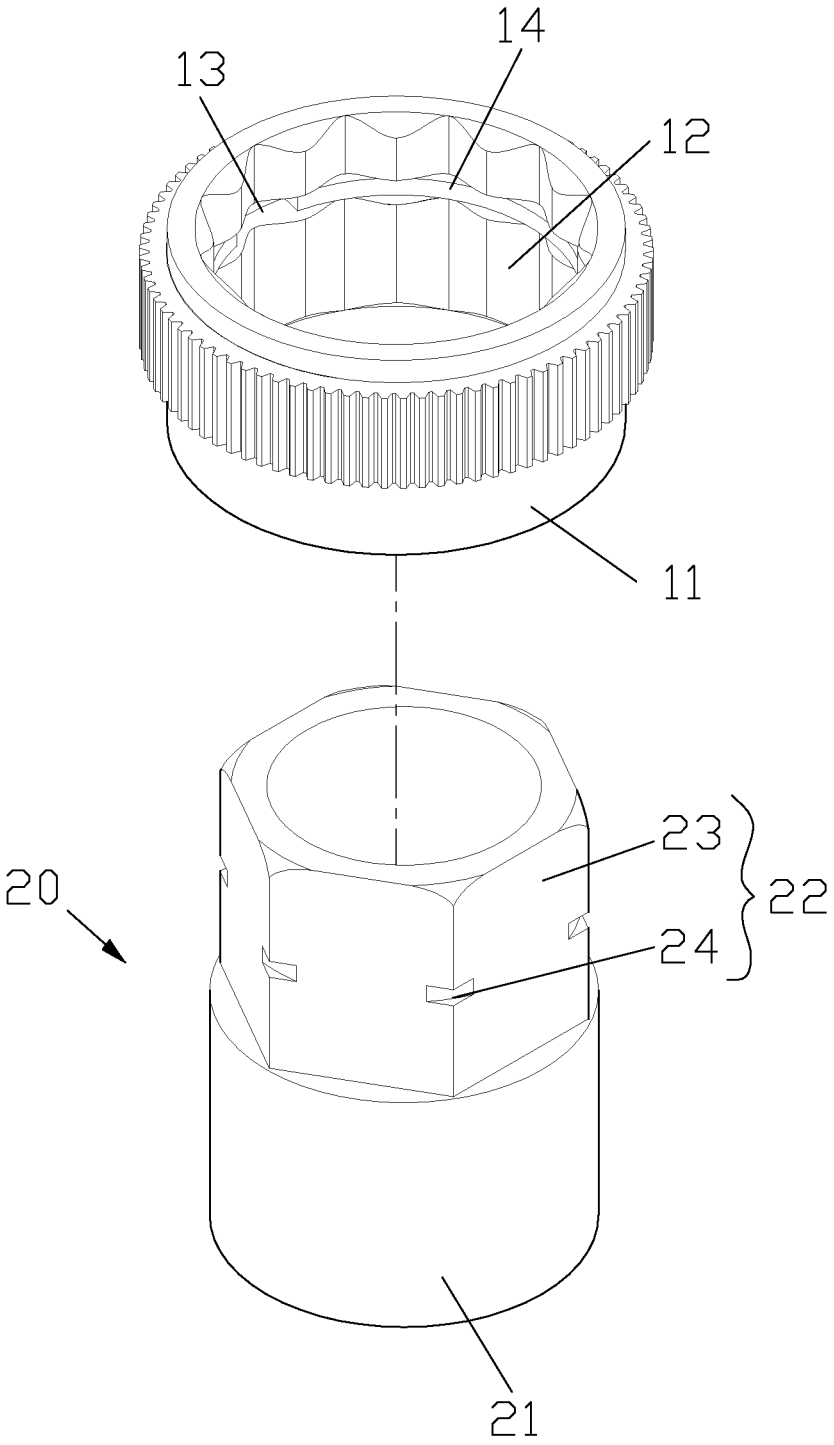
FIG. 2 shows a conventional fitting structure for tools.
Figure 3:
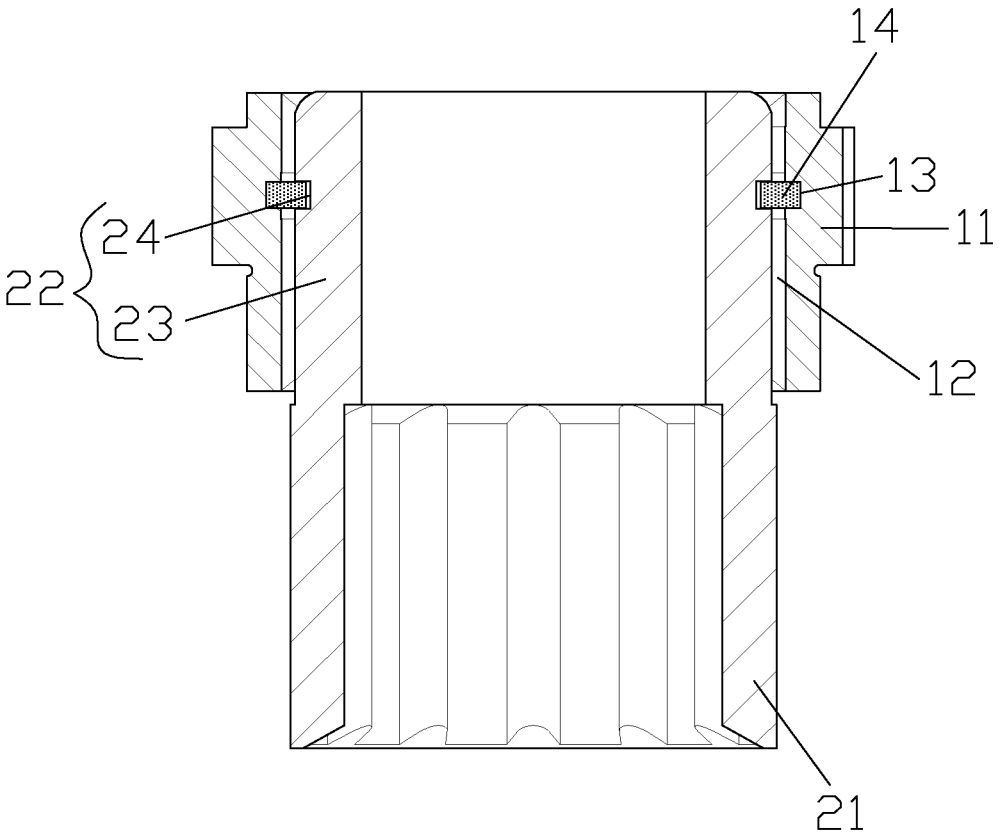
FIG. 3 also shows the conventional fitting structure for the tools.
Figure 4:
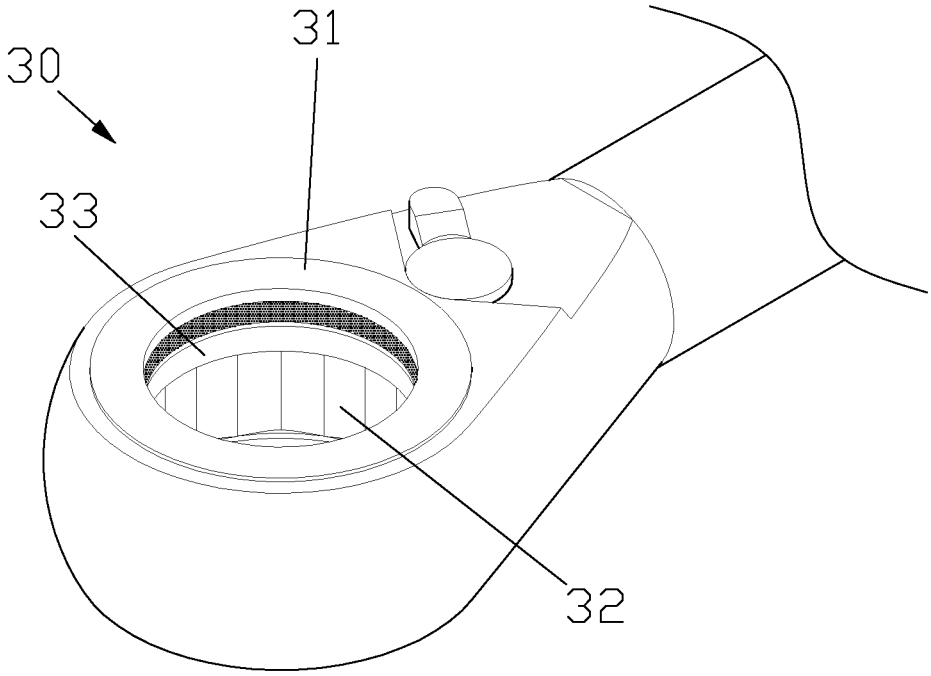
FIG. 4 is a perspective view showing the assembly of a fitting tool according to a first embodiment of the present invention.
Figure 5:
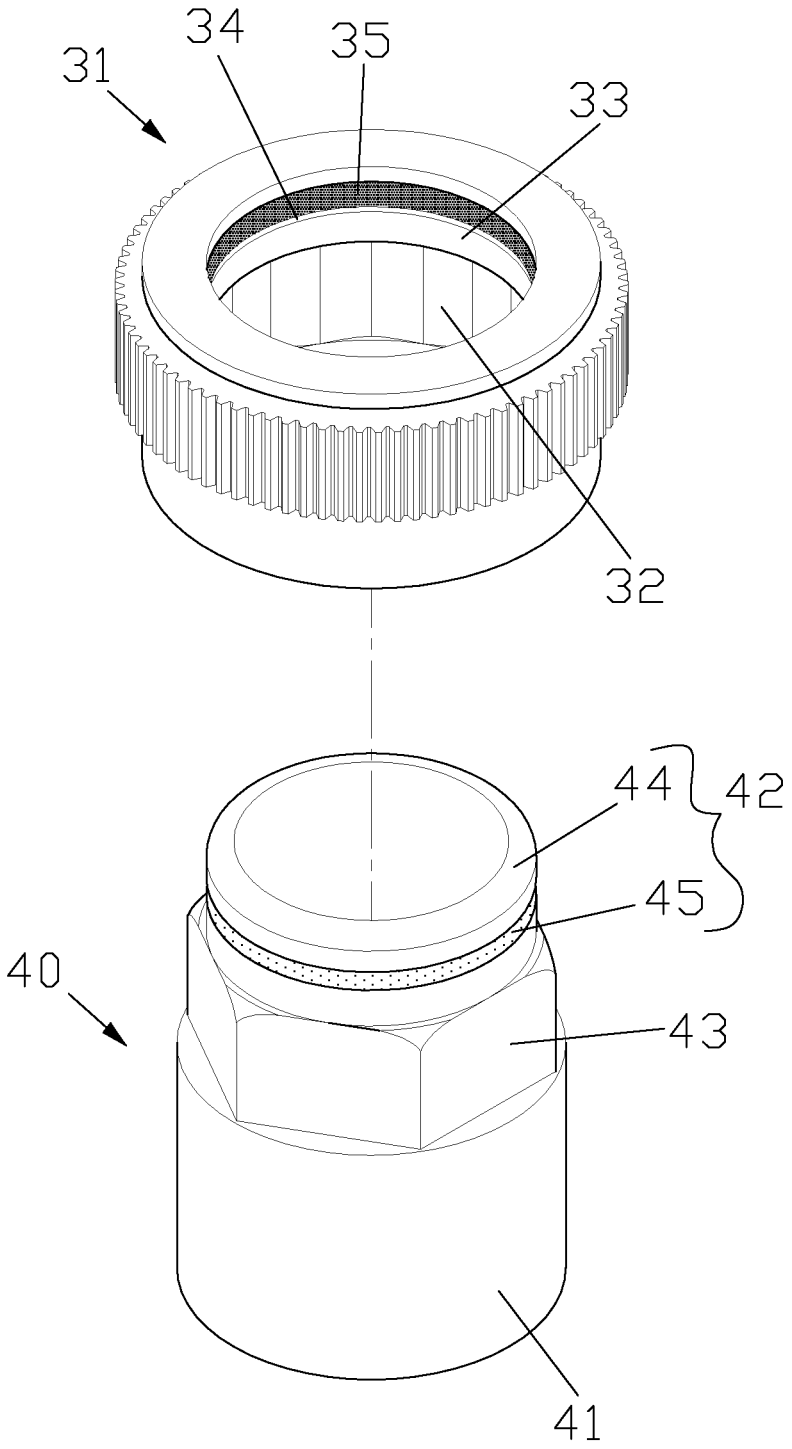
FIG. 5 is a perspective view showing the exploded components of a fitting structure for tools according to a first embodiment of the present invention.

Referring to FIGS. 4 and 5, a fitting structure for tools according to a first embodiment of the present invention comprises: a fitting end 31 of a fitting tool 30 and a fitted end 42 of a fitted tool 40. In this embodiment, the fitting end 31 is used for an adaptor of a wrench tool as shown in FIG. 4, wherein the fitting end 31 includes a toothed retaining area 32 formed on an inner wall thereof, a concaved portion 33 defined on an upper end thereof, a peripheral groove 34 arranged around the concaved portion 33, and a ring 35 made of plastic material and disposed in the peripheral groove 34. In this embodiment, the fitted end 42 of the fitted tool 40 is applied for a socket tool as illustrated in FIG. 5, wherein the fitted tool 40 includes a working portion 41 arranged on a lower end thereof, a polygonal engaging portion 43 defined over the working portion 41, an annular locking portion 44 formed over the polygonal engaging portion 43, wherein the polygonal engaging portion 43 and the annular locking portion 44 are connected together to form the fitted end 42. In addition, the annular locking portion 44 has an annular lock trough 45 defined thereon, and the annular lock trough 45 has a color marking element fixed therein for identifying the fitted tool 40 clearly and easily.

Figure 6:
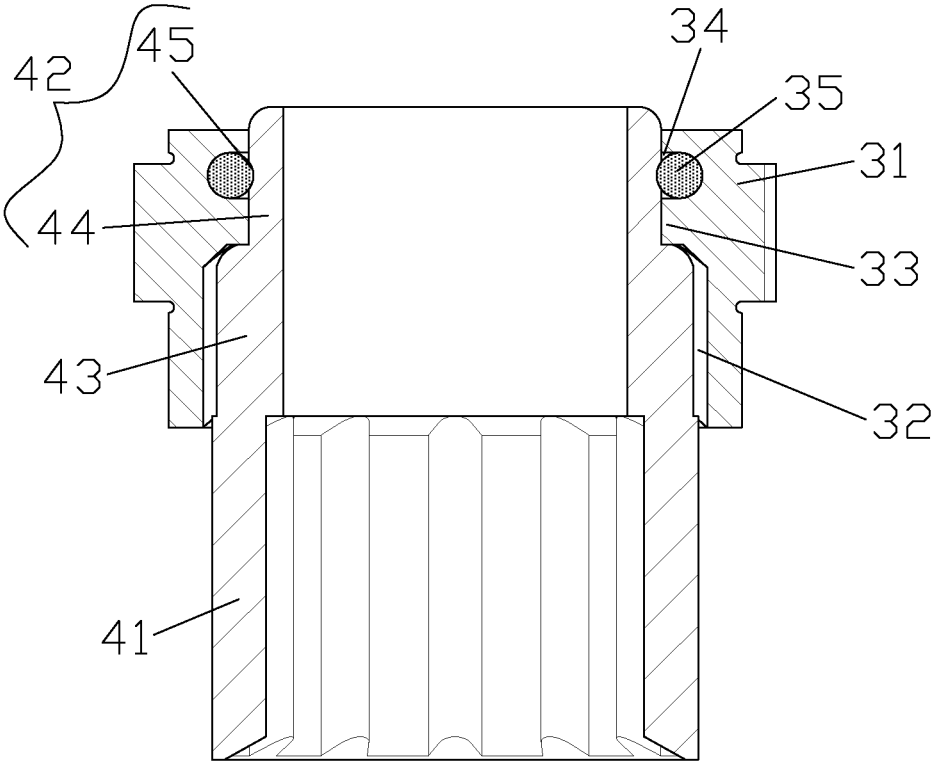
FIG. 6 is a cross sectional view showing the assembly of the fitting structure for the tools according to the first embodiment of the present invention.

Referring further to FIG. 6, when the fitting end 31 of the fitting tool 30 is connected with the fitted end 42 of the fitted tool 40, the polygonal engaging portion 43 of the fitted end 42 retains in the toothed retaining area 32 of the fitting end 31, and the annular locking portion 44 of the fitted end 42 is engaged in the concaved portion 33 of the fitting end 31, the fitting tool 30 is retained in the annular lock trough 45 of the annular locking portion 44 of the fitted tool 40 by ways of the plastic ring 35, such that the fitting end 31 of the fitting tool 30 is connected with the fitted end 42 of the fitted tool 40 securely, and the fitting end 31 is removed from the fitted end 42 easily by using the plastic ring 35.

Figure 7:
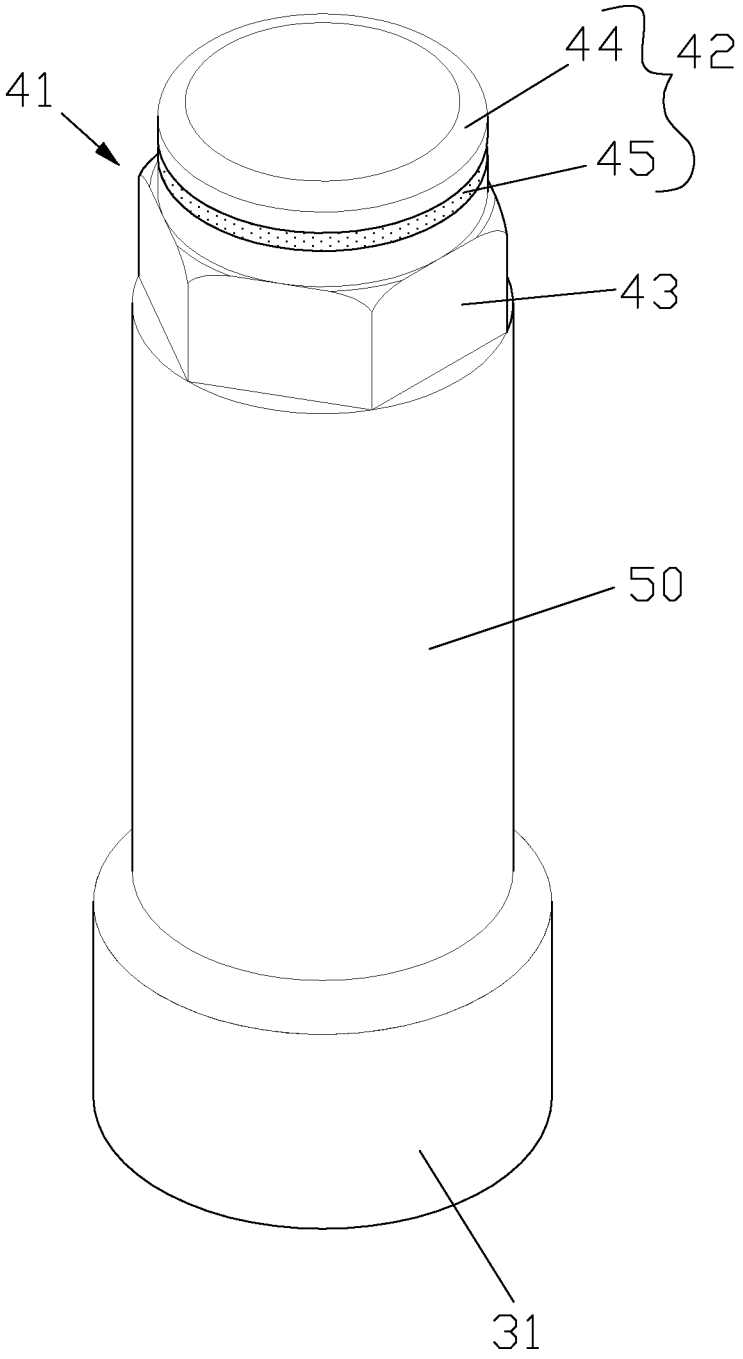
FIG. 7 is a perspective view showing the assembly of a fitting structure for tools according to a second embodiment of the present invention.
Figure 8:
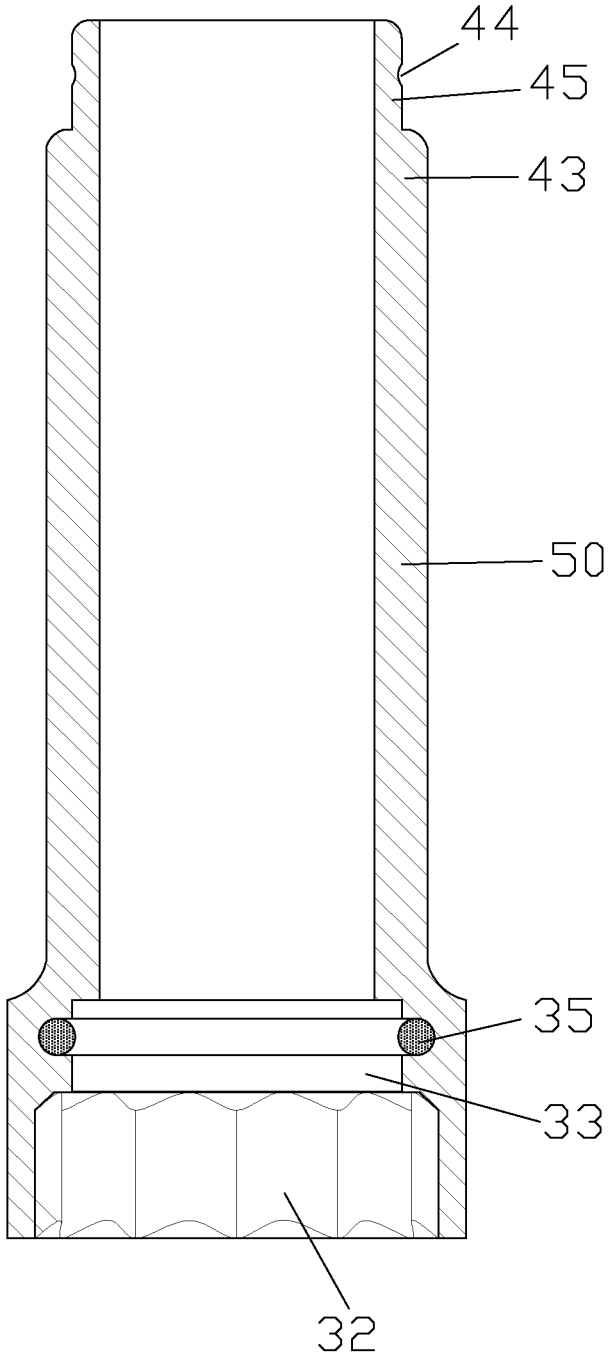
FIG. 8 is a cross sectional view showing the assembly of the fitting structure for the tools according to the second embodiment of the present invention.

With reference to FIGS. 7 and 8, a fitting structure for tools according to a second embodiment of the present invention comprises: a socket connecting rod 50, and the socket connecting rod 50 includes a fitted end 42 fixed on an upper side thereof and a fitting end 31 mounted on a lower side thereof, such that a fitting tool 30 is connected with the upper side of the socket connecting rod 50, and a fitting tool 40 is coupled with the lower side of the socket connecting rod 50.

Figure 9:
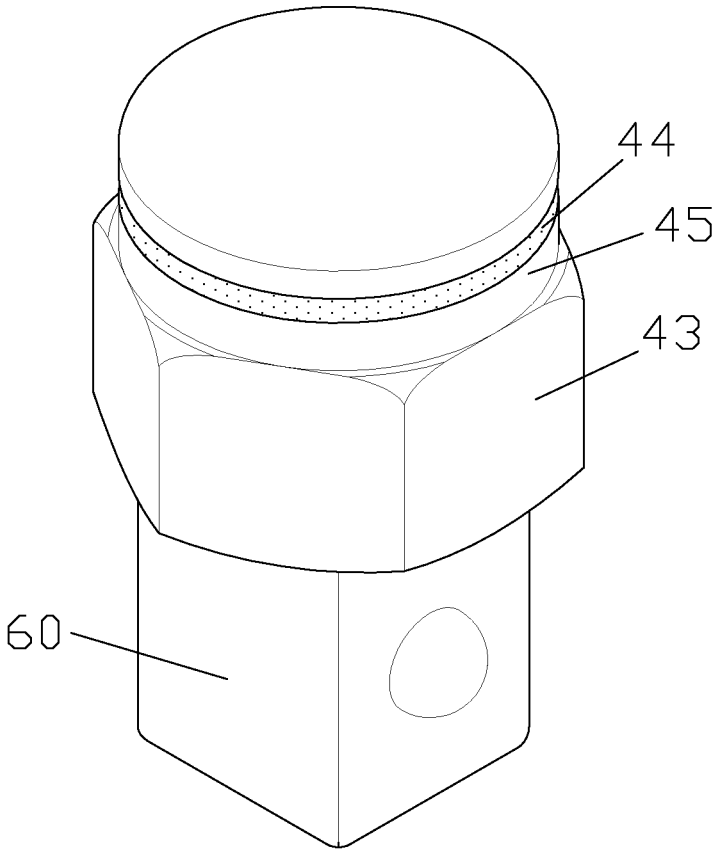
FIG. 9 is a perspective view showing the assembly of a fitting structure for tools according to a third embodiment of the present invention.

As shown in FIG. 9, a fitting structure for tools according to a third embodiment of the present invention comprises: a socket connector 60. The socket connector 60 includes a fitted end 42 for connecting with a fitting end 31 of a wrench tool.

Thereby, the fitting structure of the present invention is capable of being used for various tools, such as the wrench tool, the socket tool, the socket connecting rod, and the socket connector.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A fitting structure for tools comprising:

a fitting end of a fitting tool and a fitted end of a fitted tool;

the fitting end including a toothed retaining area formed on an inner wall thereof, a concaved portion defined on an upper end thereof, a peripheral groove arranged around the concaved portion, and a ring disposed in the peripheral groove;

the fitted tool including a working portion arranged on a lower end thereof, a polygonal engaging portion defined over the working portion, an annular locking portion formed over the polygonal engaging portion, wherein the annular locking portion has an annular lock trough defined thereon, and the annular lock trough has a color marking element fixed therein for identifying the fitted tool;

wherein when the fitting end of the fitting tool is connected with the fitted end of the fitted tool, the polygonal engaging portion of the fitted end retains in the toothed retaining area of the fitting end, and the annular locking portion of the fitted end is engaged in the concaved portion of the fitting end, the fitting tool is retained in the annular lock trough of the annular locking portion of the fitted tool by ways of the ring, such that the fitting end of the fitting tool is connected with the fitted end of the fitted tool securely.

2. The fitting structure for the tools as claimed in claim 1, wherein the fitting end is used for an adaptor of a wrench tool or is mounted on a lower side of a socket connecting rod.

3. The fitting structure for the tools as claimed in claim 1, wherein the fitted end is applied for a socket tool or is fixed on an upper side of the socket connecting rod.

4. The fitting structure for the tools as claimed in claim 1, wherein the ring is made of plastic material.

* * * * *